US005084693A

United States Patent [19]

Taylor et al.

[11] Patent Number: 5,084,693

[45] Date of Patent: Jan. 28, 1992

[54] NON-EXPLOSIVE FLAWED SUBSTRATE

[75] Inventors: Eric B. Taylor, Decatur; Lawrence E. Carter, Montpelier; Dan Kinsey, Berne, all of Ind.

[73] Assignee: CTS Corporation, Elkhart, Ind.

[21] Appl. No.: 627,645

[22] Filed: Dec. 14, 1990

[51] Int. Cl.[5] ..... H01C 1/012

[52] U.S. Cl. ..... 338/306; 338/22 R; 338/309; 29/610.1

[58] Field of Search ..... 338/22 R, 22 SD, 306, 338/307, 308, 309, 314; 337/160, 161, 162, 163, 297; 361/124, 125, 88, 93, 106; 29/610.1, 620

[56] References Cited

U.S. PATENT DOCUMENTS

| | | | |
|---|---|---|---|
| 2,263,752 | 11/1941 | Babler | 361/125 X |
| 3,836,883 | 9/1974 | Takayasu et al. | 337/163 |
| 3,978,443 | 8/1976 | Dennis et al. | 338/309 |
| 4,134,096 | 1/1979 | Denes | 338/308 X |
| 4,208,645 | 6/1980 | Harmon et al. | 337/297 |
| 4,315,235 | 2/1982 | Jacobs, Jr. | 337/161 |
| 4,467,310 | 8/1984 | Jakab | 338/308 X |
| 4,494,104 | 1/1985 | Holmes | 337/166 X |
| 4,961,065 | 10/1990 | Taylor | 338/308 |

*Primary Examiner*—Marvin M. Lateef
*Attorney, Agent, or Firm*—Albert W. Watkins

[57] ABSTRACT

A resistor configuration is illustrated that has controlled electro-thermal fracture characteristics. Control is achieved by the formation of a geometrical or compositional flaw in the resistor configuration that causes fracture to originate at a lower stress magnitude than any other stress magnitude within the configuration. The flaw is located within the geometry of the resistor configuration to prevent undesirable multiple fragmentation.

14 Claims, 3 Drawing Sheets

NON-EXPLOSIVE FLAWED SUBSTRATE

BACKGROUND OF THE INVENTION

1. Field of the invention

This invention relates generally to electrical components, which, when exposed to extra-ordinary circumstances, will fail in a safe and controlled manner. This invention relates most specifically to electrical resistors, although one of ordinary skill may apply this invention to a variety of components and systems.

2. Description of the related art

Known electrical resistors are formed from various compositions that are electrically conductive to controlled or generally predictably varying degrees. These compositions may be deposited upon a substrate via vapor deposition, screen printing, immersion coating, or a host of other techniques, or may form the physical and the electrical structure.

Once a resistor has been formed into a suitable structure, the resistor is incorporated into a circuit using a variety of known techniques. After circuit assembly a variety of electrical and thermal energies are applied to the resistor which influence the stability of the resistor. In some instances the resistor is subjected to extreme current flow for longer time durations than the resistor can withstand. This generally will result in some form of irreversible destructive failure. The failure mode may take the form of resistance values that vary widely from the original design values, destructive separation of parts or fragments of the resistor material, or even combustion of the compositions that comprise the resistor.

In view of the observed failure modes, Original Equipment Manufacturers have established special requirements for these components. The devices must not become fire, safety or electrical hazards when subjected to extreme voltage inputs.

To meet the special OEM requirements, manufacturers of resistors have attempted to produce fail-safe resistors that incorporate one of several features known to protect the resistor and surrounding equipment. For example, prior art fusible or failsafe resistors produce an electrical and/or mechanical disconnection of power when the resistor is electrically overloaded. Some techniques for disconnection of poWer include: the physical addition of a separate and distinct fuse adjacent to the resistor; the combination of a fuse link or fuse element adjacent with or integral to the resistor; the use of a thermally sensitive substrate or device, which, when thermally stressed, produces some disconnection of power to the resistor; the use of a controlled resistance film thickness, which, when overloaded, evaporates; and other known techniques.

More recently, Taylor in U.S. Pat. No. 4,961,065, assigned to the assignee of the present invention, discloses a technique for controlling the breakage of a resistor substrate. That patent describes the manufacture of a fusible substrate by scribing the substrate at predetermined stress locations. The scribe marks cause programmed shattering of excessively thermally stressed substrates. When subjected to an overload, the substrate will fragment and interrupt the circuit continuity.

Yet, the fail-safe resistors described in the Taylor patent as well as prior art resistors that incorporated no protective function all suffer from a common drawback. When subjected to an overload of much greater energy than the fail-safe or anticipated energy, unpredictable events may occur. One particularly troublesome event is the "explosion" of the resistor substrate, be this substrate the resistive composition per se or a separate physical support. Fragmentation and associated ejection of solid material into the surrounding environment typically accompanies an "explosion." Because the safety of those workers and equipment operators who might be exposed to flying fragments is an OEM concern, OEM purchasers have determined that the prior art is inadequate to meet safety requirements.

SUMMARY OF THE INVENTION

In accord with the present invention, a substrate includes a flaw of appropriate dimension and composition. Lower stress results at the exterior of the flawed substrate during electro-thermal fracture because fracture occurs somewhat earlier in the flawed substrate than in an equivalent un-flawed substrate. As a result, fracture occurs without the formation of small fragments that might otherwise cause injury.

DESCRIPTION OF THE PREFERRED EMBODIMENT

The present inventors have observed that electro-thermally generated failure typically results in the formation of multiple fractures located in areas of maximum stress. Further, the velocity of particles leaving the fracture area is proportional to internal stress at the time of fragmentation. The present invention teaches the location of a flaw of appropriate dimension within the substrate at a region where fragmentation would otherwise not originate. Fragmentation thereby occurs sooner than in an un-flawed substrate. Early fracture lowers stress generated across the bulk of the exterior of the substrate, thereby reducing fragmentation.

Figure 1:
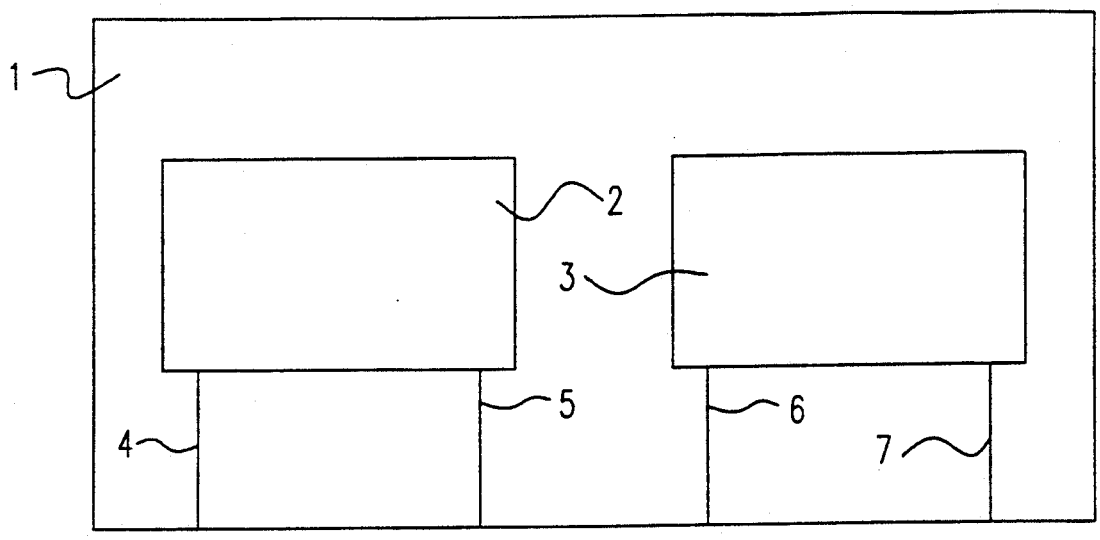
FIGURE 1 (PRIOR ART)
FIG. 1 illustrates a typical prior art resistor configuration.
Figure 2:
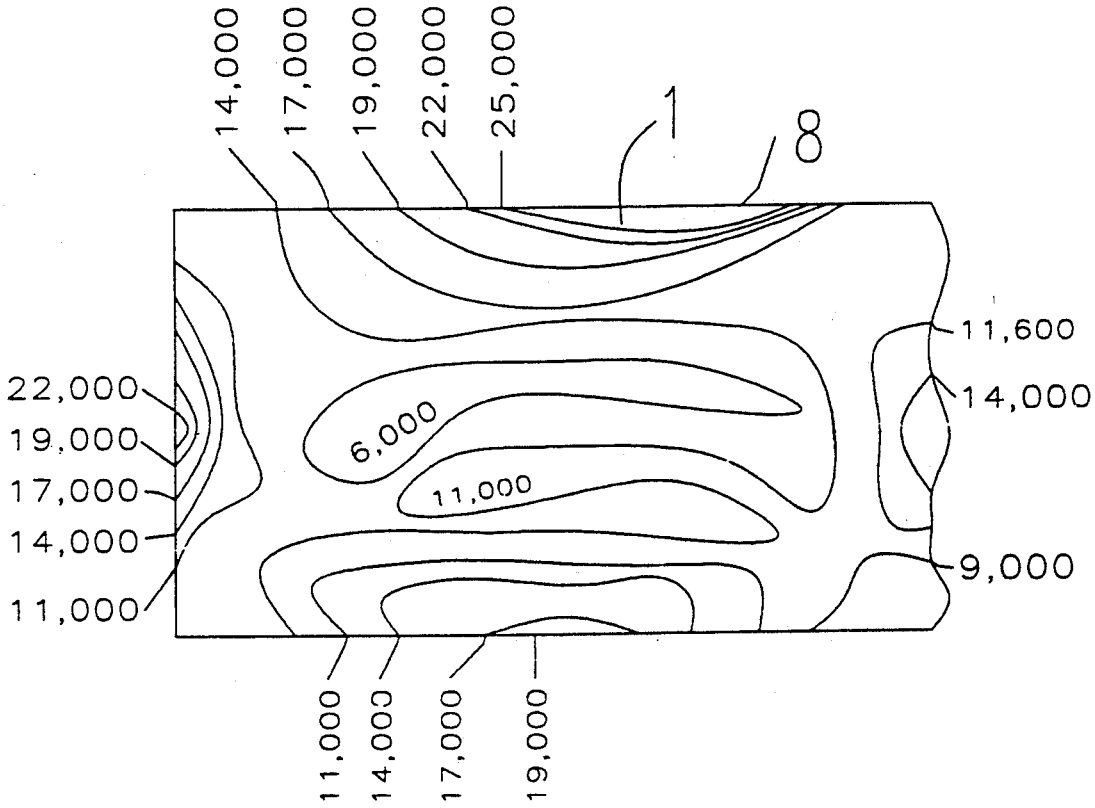
FIGURE 2 (PRIOR ART)
FIG. 2 illustrates a typical thermal stress diagram for a single prior art resistor such as resistor 2 illustrated in FIG. 1.

Referring now to prior art FIG. 1, a typical prior art resistor configuration is illustrated. The resistors 2 and 3 have been formed upon a substrate 1, which might be alumina for example, by screen printing and then firing or other known technique. Electrical connection is made to resistors 2 and 3 via conductors 4, 5, 6 and 7. These conductors may be connected to external circuitry 20 via solder attached terminations, wire-bonding or other known techniques. Referring to FIG. 2, which illustrates a stress diagram typical for the prior art resistor of FIG. 1 in a thermally stressed condition, there are many stress lines illustrated. A stress plot of this nature may be generated using a variety of thermal modeling software packages available on a personal computer, or, if needed, there are commercial services available to perform this type of modeling. Swanson Analysis Systems, Inc. of Houston, Pa. sells one such software package suited for thermal modeling under the acronym ANSYS.

The stress plot shown in FIG. 2 is noteworthy in that the original substrate has a maximum stress point 8 where any fracture of the substrate due to electro-thermal factors is likely to originate. A maximum thermal stress point such as point 8 results in a fracture that is not a simple division of the substrate into several large distinct pieces, but rather a division into many fragments of varying size. The formation of many fragments is a direct result of the large area of high tensile stress that is present. In the illustrated design, the large area of high tensile stress is a result of the location of two planar surface at the edge, both of which are under substantial tensile stress.

Figure 3:
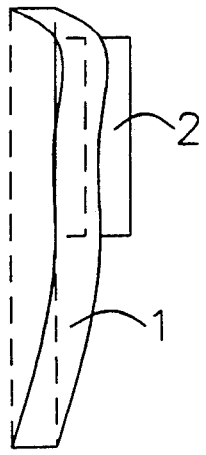
FIG. 3 illustrates the bending motion of an electro-thermally stressed resistor as otherwise configured in prior art FIG. 1.

Referring to FIG. 3, which is a side view of the prior art resistor of FIG. 1, the dotted lines represent the resistor in an unstressed condition. The introduction of electro-thermal energy via resistor 2 causes substrate i to deform as illustrated by the solid lines. This deformation is dramatic. Those points on the surface of substrate 1 opposite resistor 2 are in compression. Those points on the surface that is on the same side of the substrate as resistor 2 are in tension. Those artisans familiar with ceramics are aware that ceramics are strong when placed in compression and weak when placed in tension. At some time when sufficient bending has occurred, sufficient tensional forces will be produced at the surface shared by resistor 2 to produce a fracture. From the stress plot in FIG. 2, this would be at point 8. A rapid generation of electro-thermal energy creates and ejects small fragments during fracture. The ejected fragments typically attain significant velocities and thereby become safety hazards. This clearly does not meet the OEM requirements for safety of workers and equipment operators.

To overcome the limitations of the prior art, the present inventors have determined that proper placement of a small flaw, such as might be formed by a laser scribe or cut notch, results in a relocation of the maximum stress point to a region of otherwise reduce tensile stress. This flaw eliminates the formation of small fragments that leave the substrate with high velocity. Additionally, since the presence of the flaw reduces somewhat the energy load that has accumulated just prior to fragmentation, there is less total energy released by fracture. In fact, with proper design, the substrate fractures without the formation of any flying fragments. This meets the OEM's requirements for safety.

Figure 4:
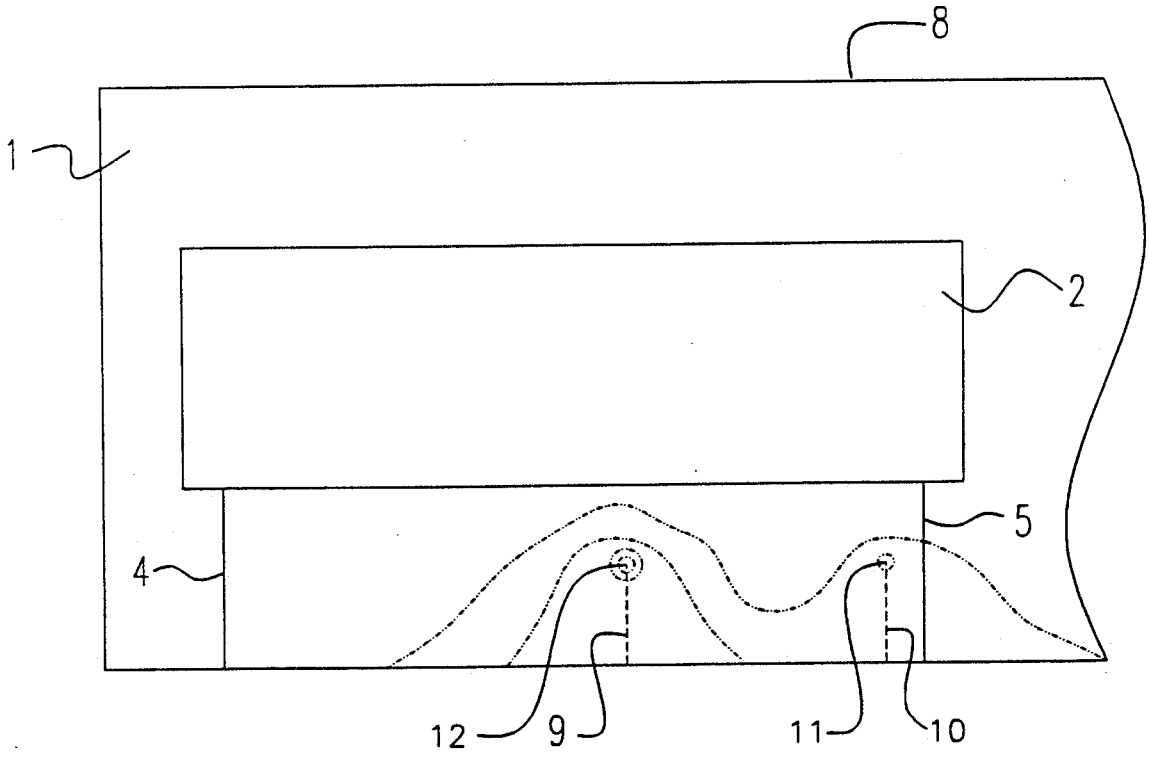
FIG. 4 illustrates a stress pattern as might be generated in accord with the preferred embodiment of the present invention.

By thermally modeling the substrate with a flaw, such as 9 or 10 of FIG. 4, the present inventors have demonstrated, and later created, a point of greater stress than point 8. For purposes of illustration, two flaws 9 and 10 are shown in FIG. 4, although in practice only a single flaw would be needed. These flaws are dimensioned to locate the origin of fracture far enough from the regions of high tensile stress to produce little fragmentation. As shown in FIG. 4, if the stress at point 8 is of a magnitude designated mathematically by X, the stress at point 11, the maximum stress along flaw 10, is only three-quarters as great, or ¾times X. With a flaw 9 of the same length as flaw 10 repositioned closer to the center of the body of resistor 2, the maximum stress occurs at point 12 and is twice as much as point 8, or equal to 2 times X.

The stress produced at point 11 is insufficient to produce a fracture that originates at point in view of the greater magnitude at point 8. Therefore, a flaw in this location will not adequately protect the safety of the workers. However, the stress created at point 12 is sufficiently great that substrate fracture originates at point 12. Very little if any fragmentation accompanies this fracture and any fragments produced have a very low separation velocity. This flaw location does protect the safety of the workers as required by the OEM's.

The inventors have found that the original stress diagram such as illustrated in FIG. 2 is inadequate to predict the success or failure of the flaws used in the present invention to prevent fragmentation. To adequately identify the stresses generated, a new stress model must be produced that includes the variables introduced by the flaw, such as the depth and placement of the flaw. In the present example, for a substrate 0.040' thick a laser scribe 0.010' to 0.015' into the thickness of the substrate is adequate to cause the substrate to break into two "halves" without ejection of loose pieces into the surrounding environment.

The bending motion illustrated in FIG. 3 is significant, as placement of the same scribe of 0.010' depth upon the side of the substrate away from resistor 2 will not produce the intended effect. Instead, the substrate flexes and places the scribe area in compression, preventing early rupture of the substrate. For a typical scribe upon the side of the substrate opposite resistor 2, the substrate still breaks initially at point 8.

Figure 5:
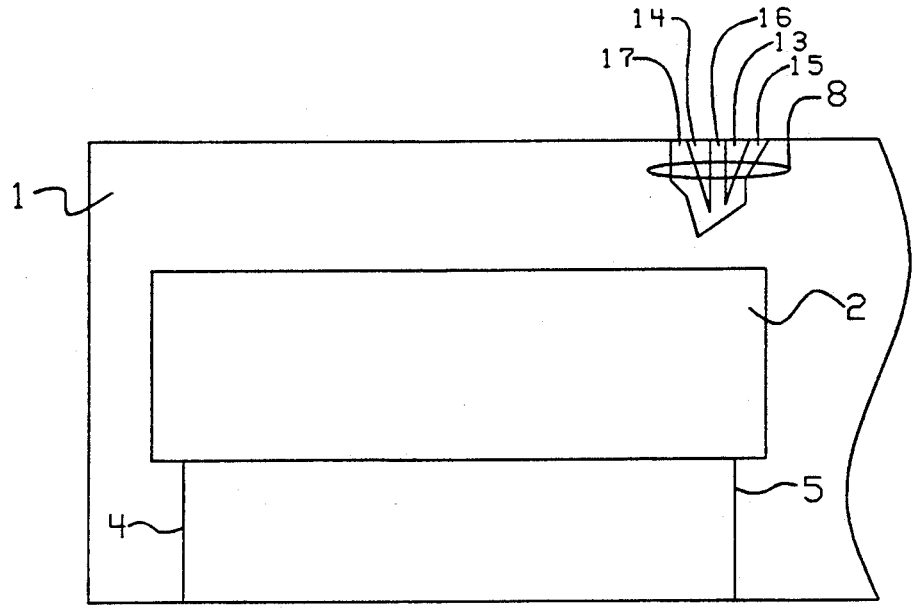
FIGURE 5 (PRIOR ART)
FIG. 5 illustrates a prior art resistor configuration during initial fragmentation.
Figure 6:
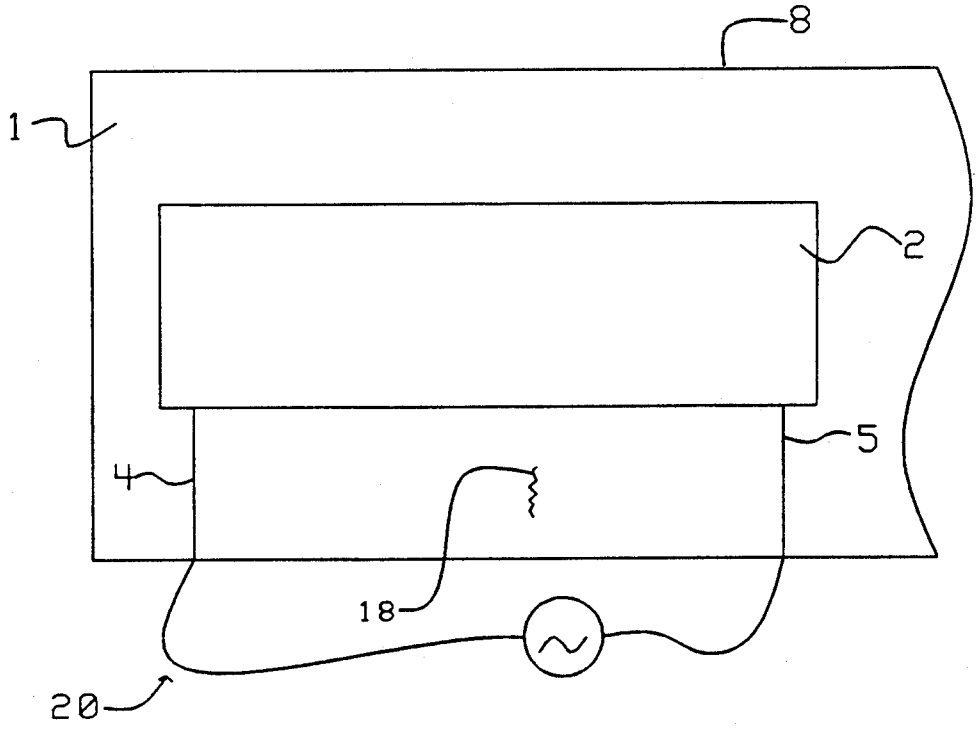
FIG. 6 illustrates the resistor configuration of the preferred embodiment during initial fragmentation.

FIGS. 5 and 6 illustrate the concept of fragmentation of the prior art and of the preferred embodiment, respectively. In FIG. 5, fracture originates in a region around point 8, which is greatly exaggerated for illustration purposes. Because several closely spaced points are likely to exceed the structural tensile limits simultaneously, the fracture is apt to originate at the surface of the substrate in several locations. Numerals 15, 16 and 17 identify these points. As these points begin to separate and the remaining structure weakens further, small chips 13 and 14 are likely to spall off the substrate. In the illustration of figure 5, three cracks begin to propagate simultaneously and the remaining weakened substrate flexes more. This results in the formation and expulsion of fragments 13 and 14. The number of fragments expelled is entirely dependent upon the homogeneity of the original substrate and the original geometry. Homogeneity is significant since several cracks may begin simultaneously at differing stress levels if the substrate is not perfectly homogeneous. Geometry plays a role in determining how large an area encompasses stresses that are at or near the structural limit for the material. In the prior art, there are large regions of the substrate surface that are either at or near the structural limits for tensile stress. A crack propagating in one region is likely to cause substantial flexure in the remaining substrate. The additional flexure may increase the tensile stress in another region, thereby exceeding structural limits in several locations nearly simultaneously.

The present invention overcomes the limitations of the prior art by creating a small flaw (9 in FIG. 4) that extends into to the substrate. As a result, a fracture 18 in FIG. 6 will originate at a location (12 in FIG. 4) which is more interior than in the prior art. Since the flaw already separates the exterior surface, little if any spalling will occur at the site of origination. Additionally, the surface region is not exposed to fracture magnitude tensile stress other than at the apex of the crack as the crack propagates. A reduction of branching results since there is no other region of the substrate, other than the apex of the crack, which has reached sufficient tensile stress to fracture.

The prior art mode of fracture accompanied by spalling and multiple crack propagation is in stark contrast to the more controlled mode of single crack propagation of the present invention. The result is equally distinguishable, as the prior art devices tend to fragment into many projectiles while resistors designed in accord with the present invention tend to break very cleanly and with little imparted velocity.

Another advantage of the location of the crack in the preferred embodiment comes from the resulting synergism between the illustrated resistor structure and a polymer covercoat typically applied to the substrate. This covercoat is "painted" onto the substrate on the side of the substrate occupied by resistors 2 and 3 where the coating provides a limited amount of environmental protection for the resistors. Because the polymer covercoat is typically more resilient than the substrate composition, fragments formed out of the substrate in the middle of the covercoat region are not likely to be expelled from the substrate. The covercoat synergistically provides some additional retention capability.

The disclosed invention has application with many types of fail-safe resistors and standard resistors known in the prior art, without other modification. The invention is applicable to planar configurations carrying PTC devices or fuse structures, cylindrical resistors of standard type or with embedded fuse links, and many other configurations. In addition, the invention is not limited to electrical resistors per se, but is suited to any electrothermally stressed device where the electro-thermally stressed device includes a composition that undesirably explosively fractures when electro-thermally stressed.

While the foregoing details the preferred embodiment of the invention, no material limitations to the scope of the claimed invention is intended. Further, features and design alternatives that would be obvious to one of ordinary skill in the art are considered to be incorporated herein. For example, while the preferred embodiment incorporates a small laser scribe flaw, this also may be a flaw produced by other known mechanical means or which is the result of a lack of homogeneity by design as mentioned hereinabove. There are many methods for the accomplishment of a variation of homogeneity, including: the creation of voids during the molding process; the introduction of foreign material of differing characteristics; the changing of the forming process to produce localities of different densities; and other known methods. The scope of the invention is set forth and particularly described in the claims hereinbelow.

We claim:

1. An electrical structure having a first portion thereof which is electrically conductive, said electrical structure having a first geometry and first composition, wherein said first composition determines a first maximum stress limit that may be generated without fracture of said electrical structure, said first geometry and said first composition determining a first maximum stress that may be generated without fracture of said electrical structure, wherein the improvement comprises a flaw having a second geometry and second composition, said flaw having a second maximum stress limit of substantially lower magnitude relative to stresses produced by electrothermal thermal shock than any other location upon or within said electrical structure, whereby said flaw becomes the origin of any electro-thermally induced fracture of said electrical structure, said flaw located within said electrical structure first geometry whereby said fracture propagates at an apex of said fracture without generating additional fractures in said electrical structure.

2. The electrical structure of claim 1 wherein said improvement further comprises a second portion composed of said first composition and generally having said first geometry wherein said first composition is a relatively non-conductive composition.

3. The electrical structure of claim 1 wherein said first portion is comprised by a third geometry that is relatively different from said first and said second geometries and further comprised by a third composition that is relatively different from said first and said second compositions.

4. The electrical structure of claim 1 wherein said first portion is comprised substantially by said first geometry and said first composition.

5. The electrical structure of claim 1 wherein the improvement further comprises a coating means that provides environmental and electrical protection to s id first portion while simultaneously preventing a release of small fractures which might otherwise be ejected from said electrical structure during said fracture.

6. The electrical structure of claim 5 wherein said coating means is comprised by a polymeric compound.

7. The electrical structure of claim 1 wherein said first portion is comprised by a third geometry relatively similar to said first geometry and further comprised by a third composition relatively similar to said first composition.

8. The electrical structure of claim 1 wherein said first portion is comprised by said first geometry and further comprised by said first composition.

9. The electrical structure of claim I wherein said electrical structure is an electrical resistor configuration.

10. In an electrical circuit comprising a means of applying electrical energy to an electrical resistor and a means for sinking, said electrical resistor comprises:

a first region of electrically insulating material generally homogeneous composition having a first point thereon and other additional points at locations thereon different from said first point and mutually exclusive, said additional points encompassing all available points of said first region;

a second region of electrically resistive material adjacent to said first region;

a discontinuity in the homogeneity of said first region, wherein said discontinuity is of relatively small proportion when compared to said first region and wherein said discontinuity is located at said first point, which, during the application of a first amount of energy from said first means and a dissipation of a second amount of energy of lesser magnitude than said first amount from said electrical resistor, wherein said first point absent said flaw would otherwise be stressed substantially less than some of said additional points, said discontinuity induces a tensile stress of substantially greater magnitude than the magnitude of tensile stress induced in any other point within said first region;

whereby said electrical resistor will fracture without the associated generation of dangerous flying fragments of said electrical resistor when said first amount of energy is substantially greater than said second amount of energy.

11. The electrical resistor of claim 10 wherein said second region is deposited upon said first region.

12. A method of making an electrical resistor non-explosive when exposed to destructive electro-thermal energy, comprising the steps of:

determining a first maximum stress and associated first location of an origin of a first fracture for a given geometry and composition;

designing a flaw that, when located at a second location within said given geometry relatively remote from said first location and when electro-thermally stressed, will induce a second fracture in said electrical resistor and thereby prevent the initiation of said first fracture or any further fractures, said flaw being of dimension and composition to substantially retain said given geometry and said given composition;

generating said flaw in said electrical resistor at said second location.

13. The method of claim 12 comprising the additional step of forming said electrical resistor prior to said step of generating said flaw.

14. The method of claim 12 comprising the step of forming said electrical resistor simultaneously with said generating step.

* * * * *